US007597211B2

(12) United States Patent
Kang

(10) Patent No.: US 7,597,211 B2
(45) Date of Patent: Oct. 6, 2009

(54) COSMETIC CASE HAVING AN AIR VENT STRUCTURE FOR REFILL CONTAINER

(76) Inventor: Sung Ill Kang, No. 21 - 1906, Shin Ahn Apt., 876 - 16 Bono-Dong, Sangrok-ku, Ahnsan-si, Kyeonggi-do, 428-180 (KR)

( * ) Notice: Subject to any disclaimer, the term of this patent is extended or adjusted under 35 U.S.C. 154(b) by 637 days.

(21) Appl. No.: 10/524,292

(22) PCT Filed: Jul. 28, 2003

(86) PCT No.: PCT/KR03/01504

§ 371 (c)(1),
(2), (4) Date: Oct. 4, 2005

(87) PCT Pub. No.: WO2004/017788

PCT Pub. Date: Mar. 4, 2004

(65) Prior Publication Data

US 2006/0118454 A1 Jun. 8, 2006

(30) Foreign Application Priority Data

Aug. 26, 2002 (KR) ..... 20-2002-0025458 U

(51) Int. Cl.

| | |
|---|---|
| ***B65D 51/16*** | (2006.01) |
| ***B65D 43/18*** | (2006.01) |
| ***B65D 51/18*** | (2006.01) |
| *A45D 33/00* | (2006.01) |
| *A45D 33/24* | (2006.01) |
| *B65D 69/00* | (2006.01) |

(52) U.S. Cl. ..... 220/367.1; 220/256.1; 220/259.1; 220/259.2; 206/581; 132/293; 132/300

(58) Field of Classification Search ..... 220/367.1, 220/259.1, 259.2, 256.1, 203.29, 203.01, 220/373, 368, 203.19; 206/581; 132/300, 132/293, 314

See application file for complete search history.

(56) References Cited

U.S. PATENT DOCUMENTS

| | | | | |
|---|---|---|---|---|
| 5,353,818 | A * | 10/1994 | Suzuki et al. | 132/300 |
| 5,950,639 | A * | 9/1999 | Suzuki et al. | 132/294 |
| 6,311,701 | B1 * | 11/2001 | Yuhara et al. | 132/294 |

FOREIGN PATENT DOCUMENTS

| | | | |
|---|---|---|---|
| JP | 8-346 | A | 1/1996 |
| JP | 9-285336 | A | 11/1997 |
| JP | 10-192044 | A | 7/1998 |
| KR | 2000-8990 | U | 5/2000 |

* cited by examiner

*Primary Examiner*—Robin Hylton
(74) *Attorney, Agent, or Firm*—Foley & Lardner LLP

(57) ABSTRACT

A cosmetic case having a first cover for a main body and a second cover for a refill container which is inserted in a container of the main body is provided. The second cover has an air vent structure for preventing a volatile agent, which is contained in an oily and solid foundation, from volatilizing. The air vent structure of the second cover blocks the discharge of the air inside the refill container so as to prevent materials of the beauty product from ventilating when the first cover for the main body is closed after closing the second cover for the refill container. Sealing by the second cover is maintained as well as easier operation of closing because ventilation is performed by a valve provided in the second cover.

4 Claims, 9 Drawing Sheets

COSMETIC CASE HAVING AN AIR VENT STRUCTURE FOR REFILL CONTAINER

BACKGROUND OF THE INVENTION

1. Field of the Invention

Figure 1:
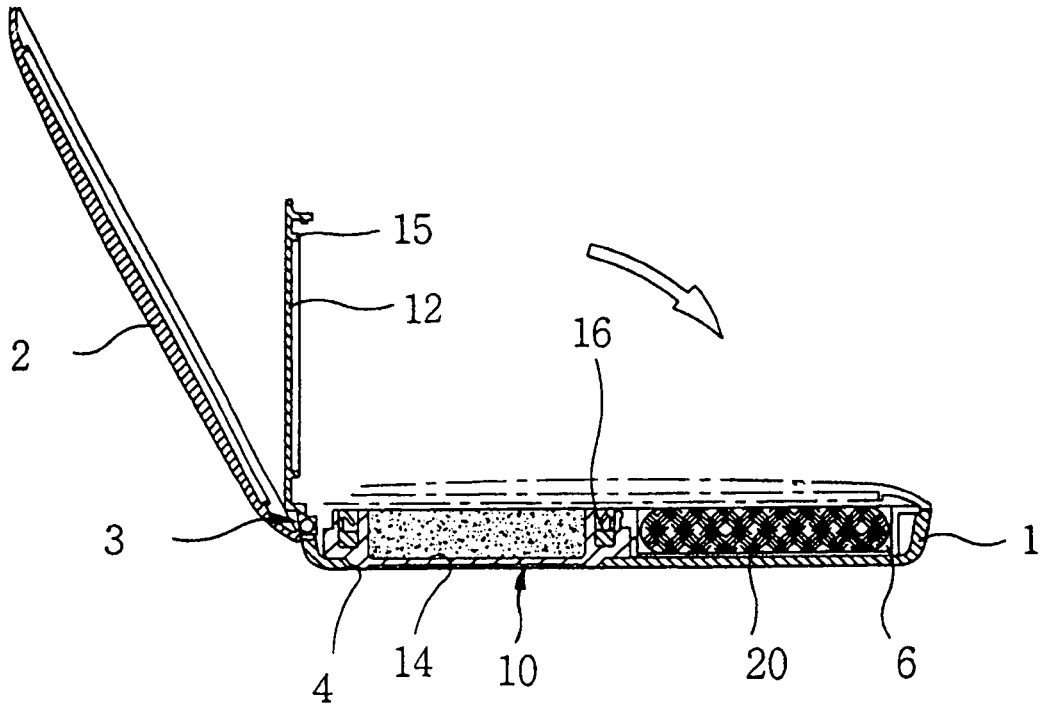

The present invention relates to a cosmetic case having an air vent structure for refill container with a sealing structure for preventing a volatile agent, which is contained in an oily and solid foundation, from volatilizing and more particularly, to a cosmetic case of having a refill container with a ventilating structure to block a discharge of the air inside the refill container so as to prevent materials of the beauty product from ventilating when the first cover of the main body of the case and to ease closing operation of the second cover to seal the refill container.

2. Description of the Related Art

In general, there are two types of solid foundations, the one is an oily type and the other is a hypogenous type. In solid foundations, most of products contain a volatile agent.

However, there is a problem that a volatile agent goes into the air by its nature as long as sealing of the case is not maintained and foundation becomes harder so that its own function becomes reduced.

There is a conventional cosmetic case having a packing structure to compensate that problem. One of the conventional cosmetic cases is disclosed in a registered Korean utility patent No. 165402 filed by applicant same to the present invention. The conventional cosmetic case, shown in FIG. 1, comprises of a main body (1), the first and second covers (2, 12) which reveal or cover the upper sides of main body (1) and refill container (10) respectively, a hinge portion (3) which is attached to the outside of the main body (1) so as to let covers (2, 12) move respectively, and locking devices for each cover are provided.

The main body (1) has a cartridge (4), in which a refill container (10) is inserted, and a powder container (6) for powder (20). The packing (16) is provided along the side-surface of the container (10) containing materials of the beauty product with a volatile agent.

Figure 2:
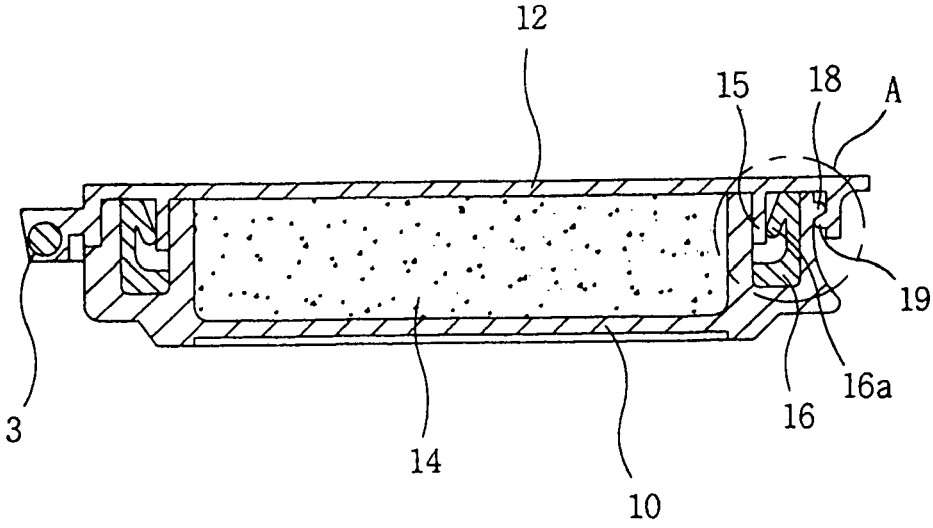
PRIOR ART FIG. 2

And referring to the refill container (10), as shown in FIG. 2, rip (15) that presses the packing (16), which is provided along outside of container (10) for preventing materials of the beauty product from ventilating, to increase adhering force is shaped to project under the second cover (12).

Figure 3A:
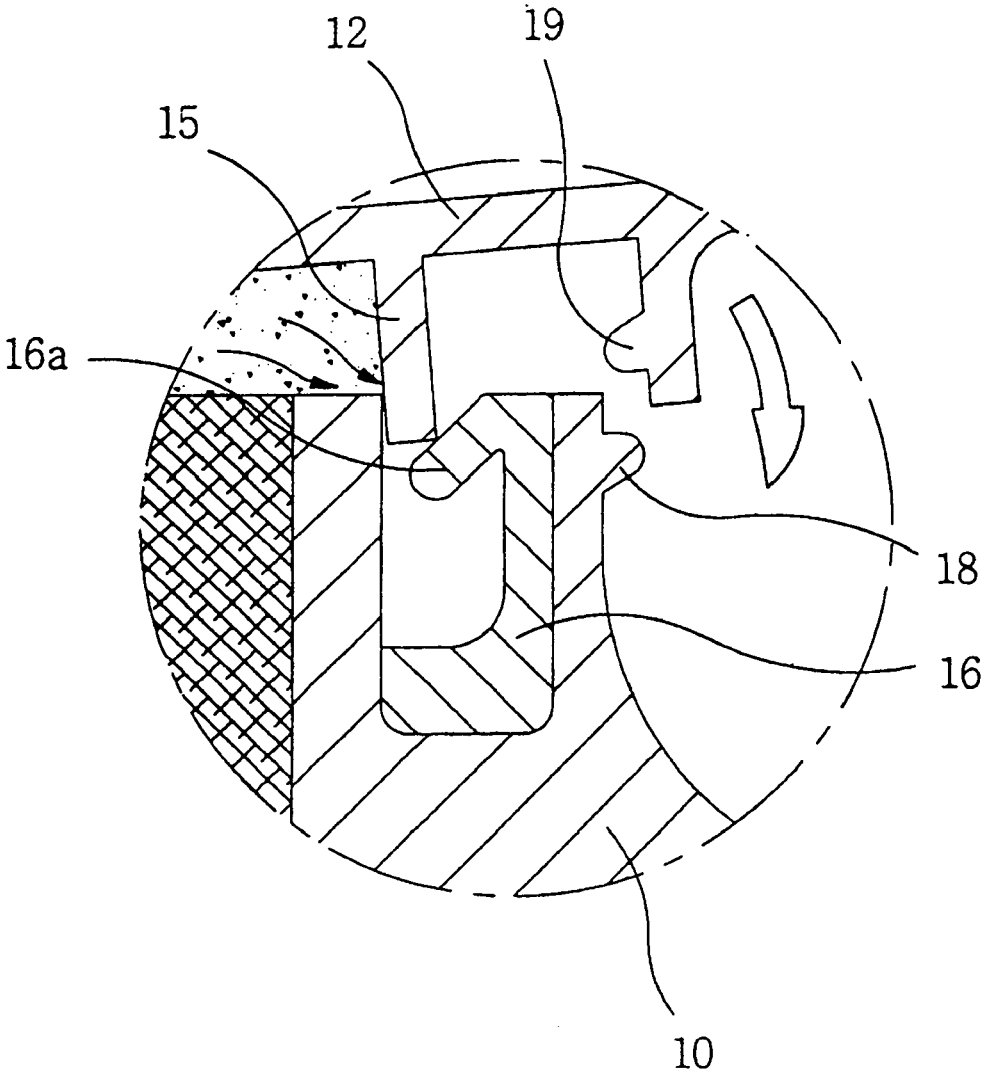
Figure 3B:
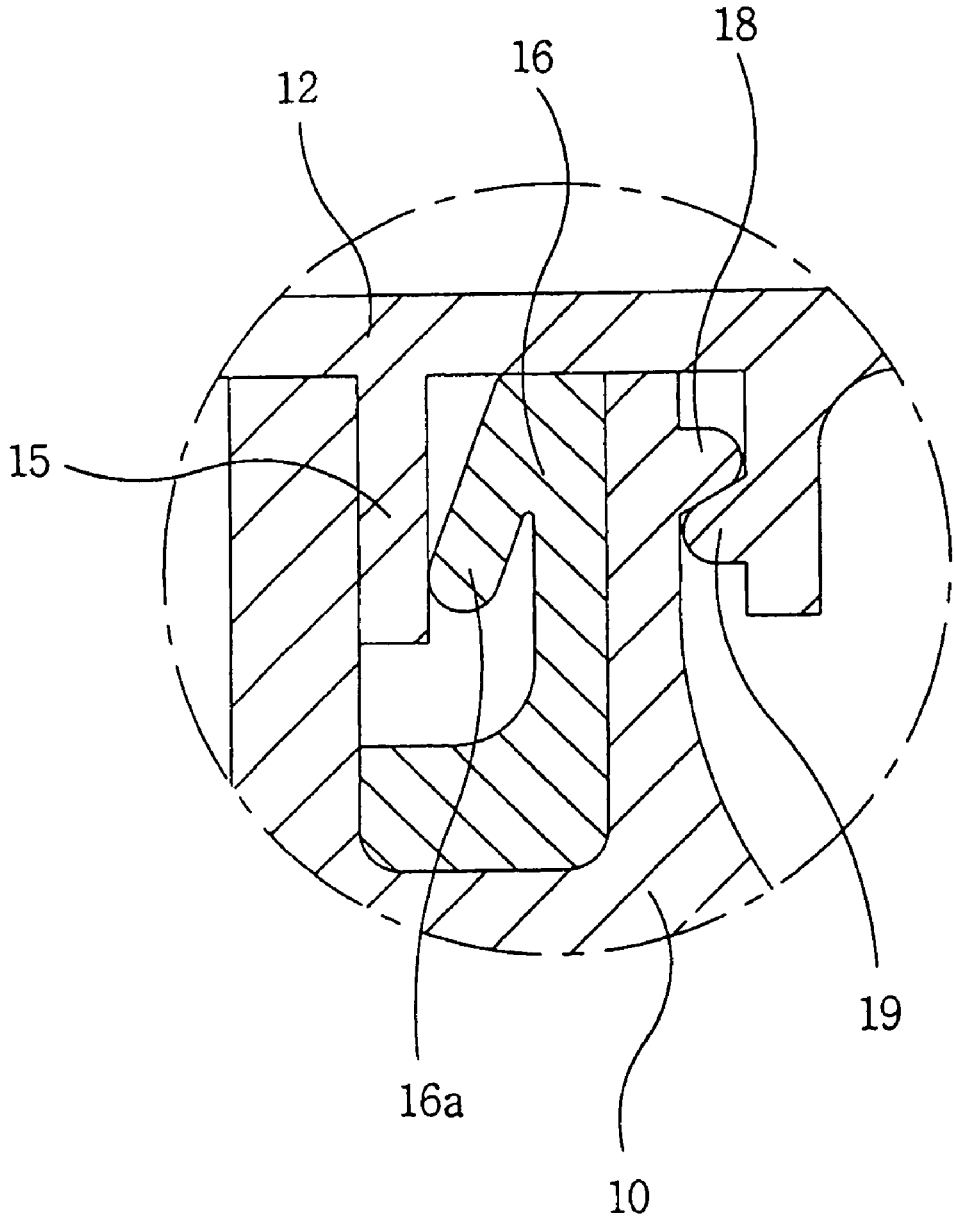

Referring to a closed state of the second cover (12) for keeping sealing, rip (15) of the second cover (12) is pressed to insert into packing (16), which is provided on the outside of the refill container (10) as shown in FIG. 3*a*, and locking piece (19) of the second cover (12) is hung on a locking step (18) of the refill container (10) so that outer air to materials of the beauty product contained inside of the refill container (10) is blocked and materials of the beauty product is prevented from volatilization (referring FIG. 3*b*).

However, in the conventional cosmetic case, though blocking function of a volatilization of materials of the beauty product by packing (16) and rip (15) is sufficient, air remained in the refill container (10) is compressed without going out. Although air inside of the case is pressed to discharge along with the closing of the second cover (12) when the second cover (12) is closed based on the hinge portion (3), sealing of the refill container (10) is started by contact of wing piece (16*a*) and rip (15) even before a locking piece (19) is hung on the locking step (18) as shown FIG. 3*a* and then air inside the refill container (10) is remained to be compressed.

Then the second cover (12) receives expanding pressure generated by a compressed air in the refill container (10) reversely when the second cover (10) is completely closed with a locking piece (19) hanging on the locking step (18) so that the second cover (12) can be opened easily by a little amount of impact or physical force to lose sealing force, thereby a volatile agency is volatilized.

As a result, lifetime of a product is shortening and reliability of a product is reduced at large degree.

SUMMARY OF THE INVENTION

The present invention is objected to solve the problem by providing a cosmetic case having a ventilating structure so that sealing and safeties is ensured by discharging air in the refill container when the second cover is closed and blocking a air duct when the first cover of a main body is closed.

According to the present invention to solve the problem; in the cosmetics case having a main body (1), first and second covers (2, 12) which reveal or cover the main body (1) and a refill container (10) respectively, a hinge portion (3) which is attached to the outside of the main body (1) so as to let covers (2, 12) move respectively, and locking devices for each cover are provided, where the main body (1) has a cartridge (4), in which the refill container (10) is inserted, and a powder container (6) for powder (20), and a packing (16) is provided along the side-surface of the refill container (10) containing materials of the beauty product with a volatile agent.

The cosmetic case is characterized in that;

a safe landing pit (122) with a first ventilating opening (124) and a valve (100) shaped by a tension plate with a protrusion portion (111) in its bottom surface and a second ventilating opening (112) are provided in the second cover (12) for the refill container (10), wherein the compressed air inside of the refill container (10) is discharged to outside thorough through the first volatilization opening (124) of the safe landing pit (122) and the second ventilating opening (112) of the valve (100) when the second cover (12) for the refill container (10) only is closed, and the first ventilating opening (124) of the second cover (12) is blocked to seal by the protrusion portion (111) of the valve (100) which is pressed downward by the first cover (2) for the main body (1) when the first cover (2) is closed after closing the second cover (12).

It is preferred that air duct (114) is provided on the upper side of the tension plate (110) of the valve (100) so as to prevent the first cover (2) from blocking the second ventilating opening (112) and blocking discharge of air when the first cover (2) is closed.

In the preferred embodiment of the present invention, crossed pits shape the air duct (114) with a constant depth on the upper side of the tension plate (110).

It is further perfected that a sunken portion (111*a*) is provided on the protrusion part (111), which is provided in the bottom side of tension plate (110), so as to increase an adhering area toward the first ventilating opening (124).

It is still preferred that the second cover (2) has a supporting plate (130) to prevent distortion by long-time usage or projection molding.

BRIEF DESCRIPTION OF THE INVENTION

Figure 4:
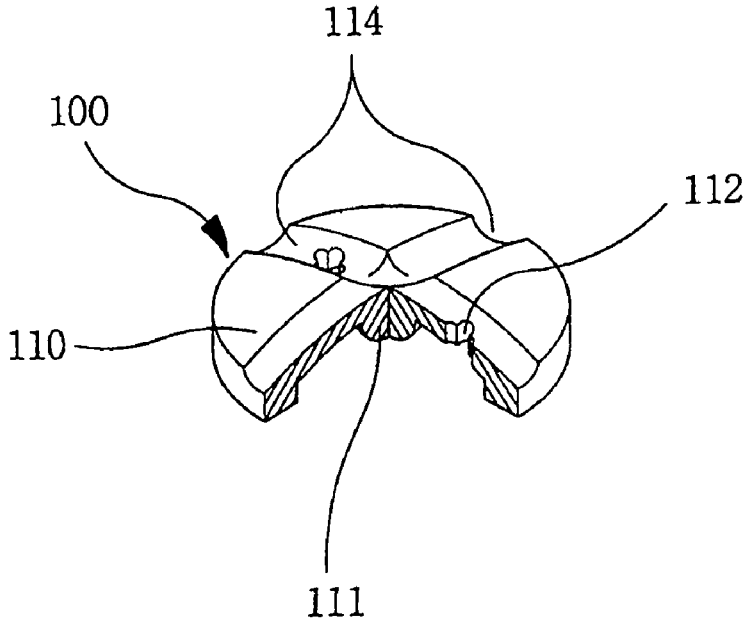
Figure 5:
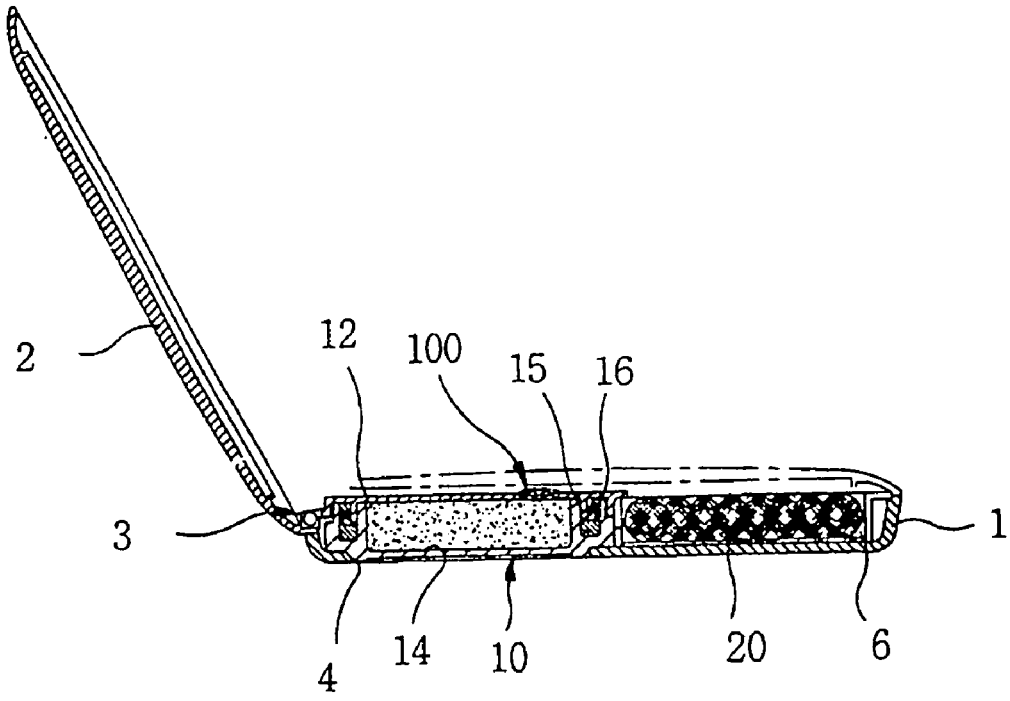
Figure 6:
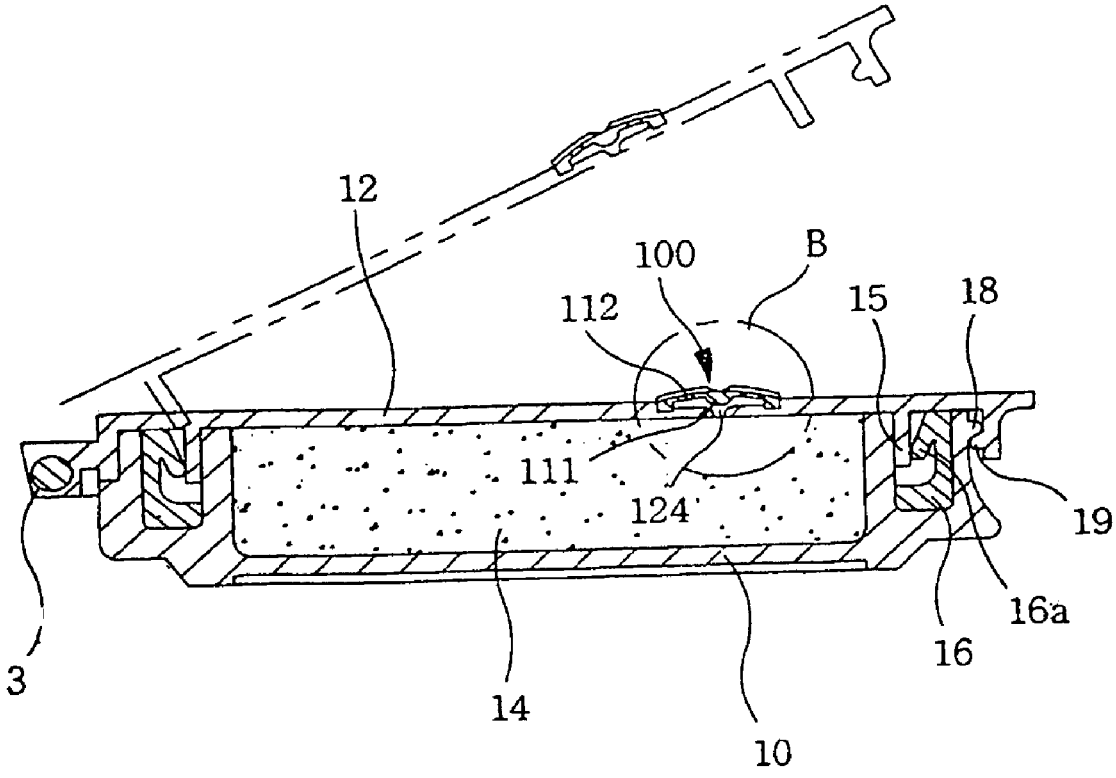
Figure 7A:
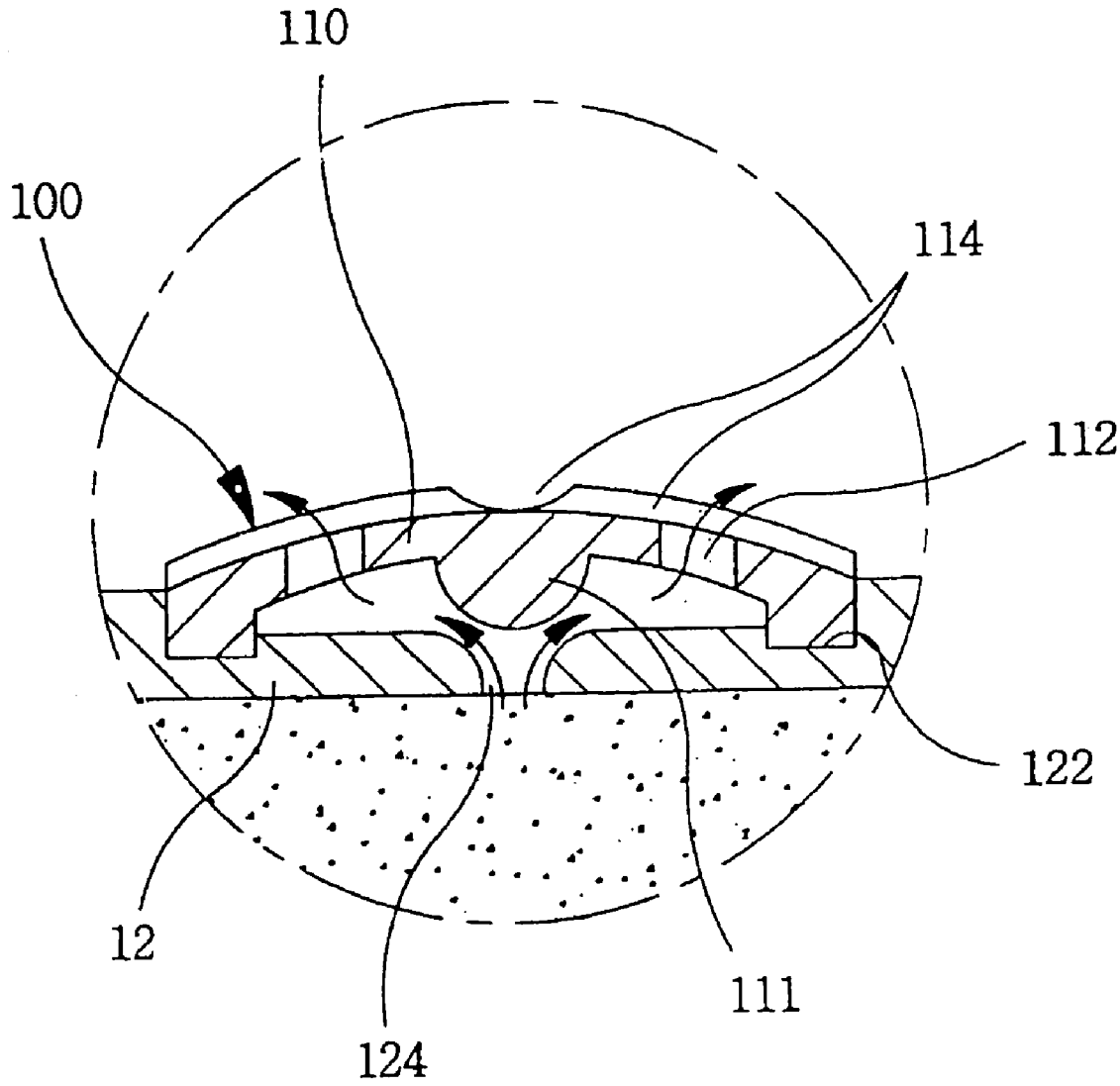
Figure 7B:
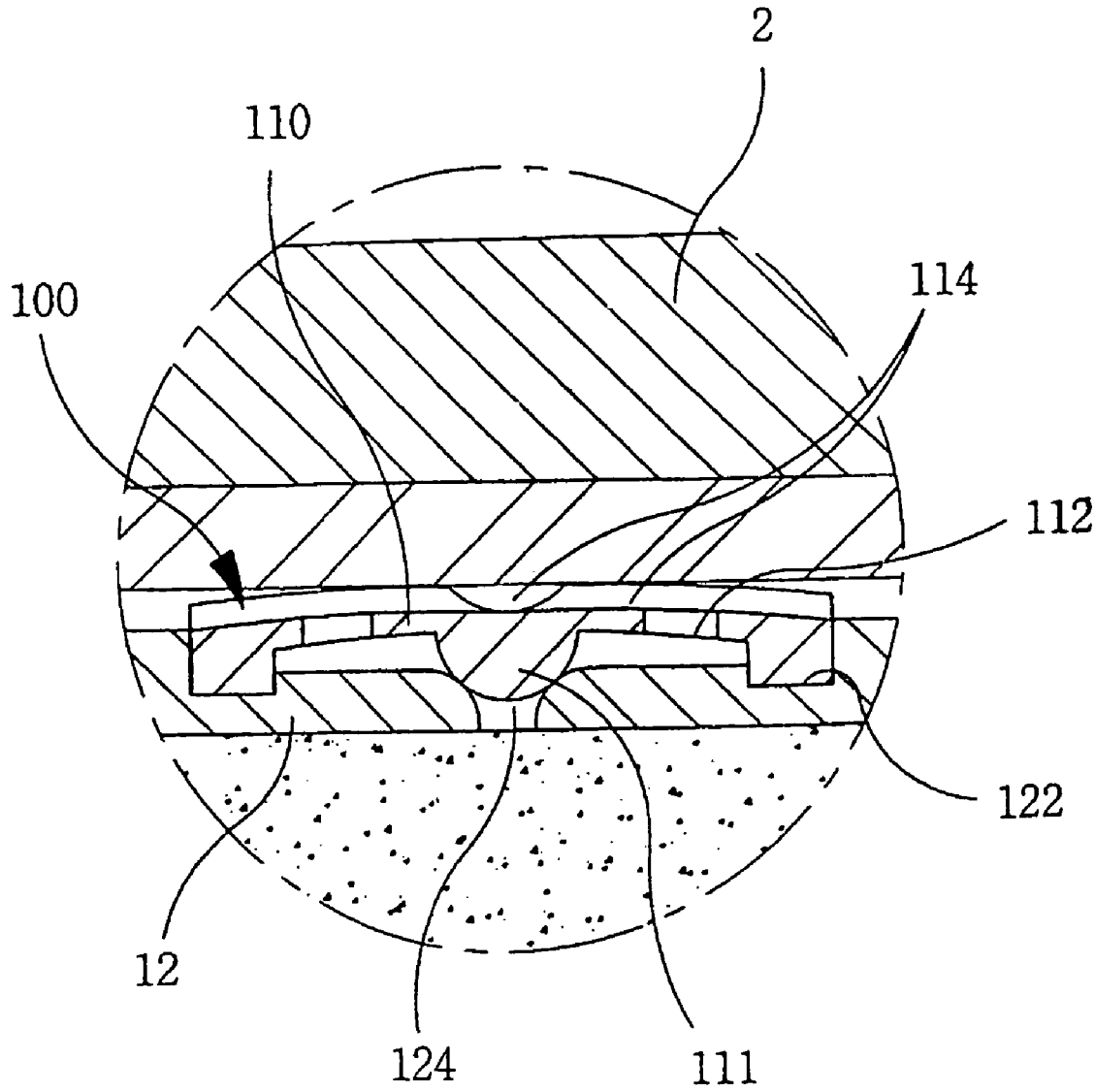
Figure 8:
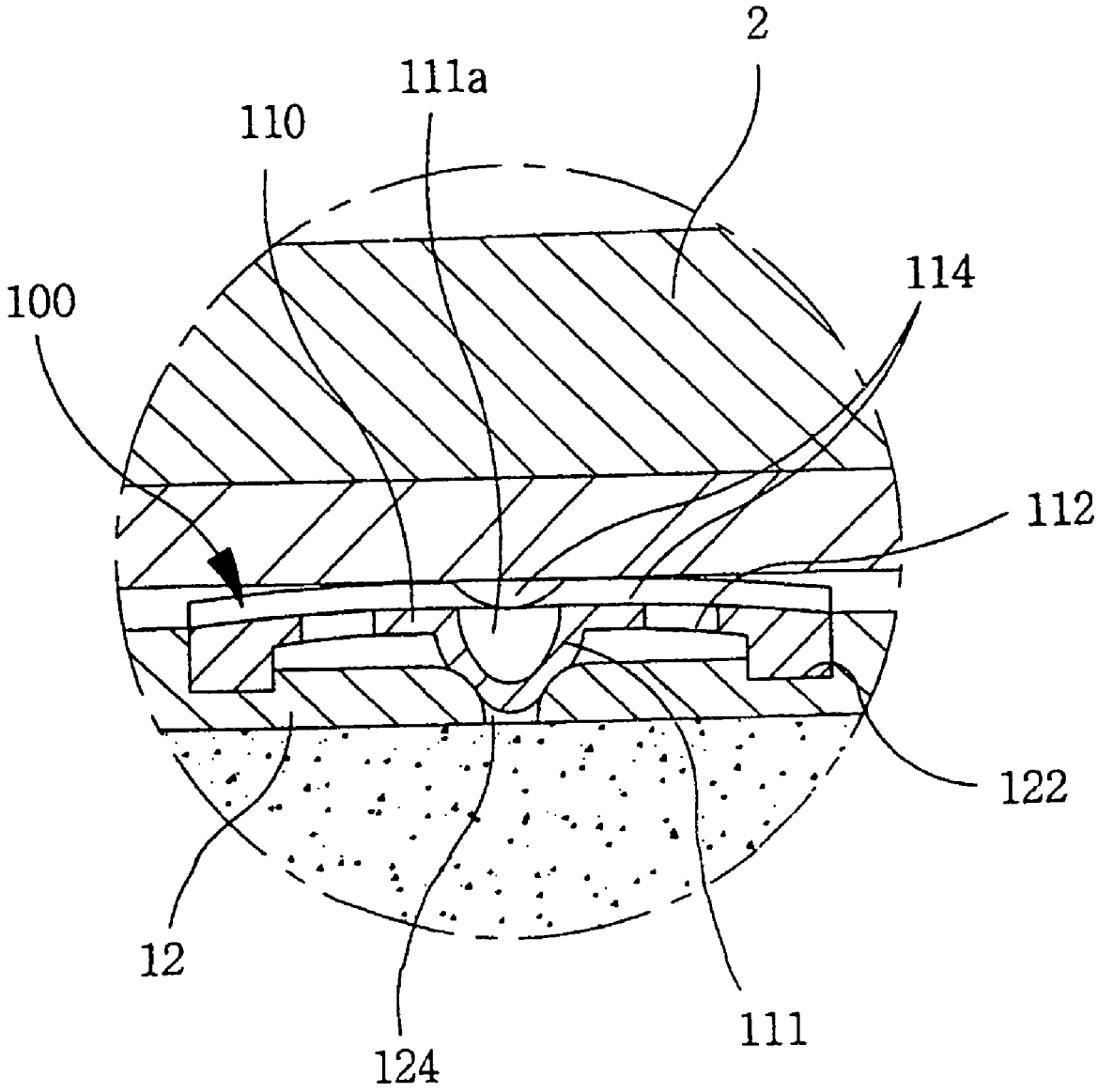

The above and other aspects and advantages of the present invention will become more apparent by describing preferred embodiments thereof in detail with reference to the attached drawings in which;

FIG. 1 is a sectional view illustrating a conventional cosmetic case in the case that its cover is opened, FIG. 2 is a sectional view illustrating a refill container of a conventional cosmetic in large scale in the case that its cover is closed, FIGS. 3*a* and 3*b* are sectional views illustrating an operation of "A" portion shown in FIG. 2, FIG. 4 is a sectional projection illustrating a valve according to a preferred embodiment of the present invention, FIG. 5 is a sectional view of a cosmetic case adapting the valve according to the present invention, FIG. 6 is a sectional view illustrating a refill container shown in FIG. 5, FIG. 7*a* is a sectional view illustrating "B" portion shown in FIG. 6 when the first cover is opened, FIG. 7*b* is a sectional view illustrating "B" portion shown in FIG. 6 when the first cover is closed, and FIG. 8 is a sectional projection illustrating a valve according to another embodiment of the present invention.

Figure 9:
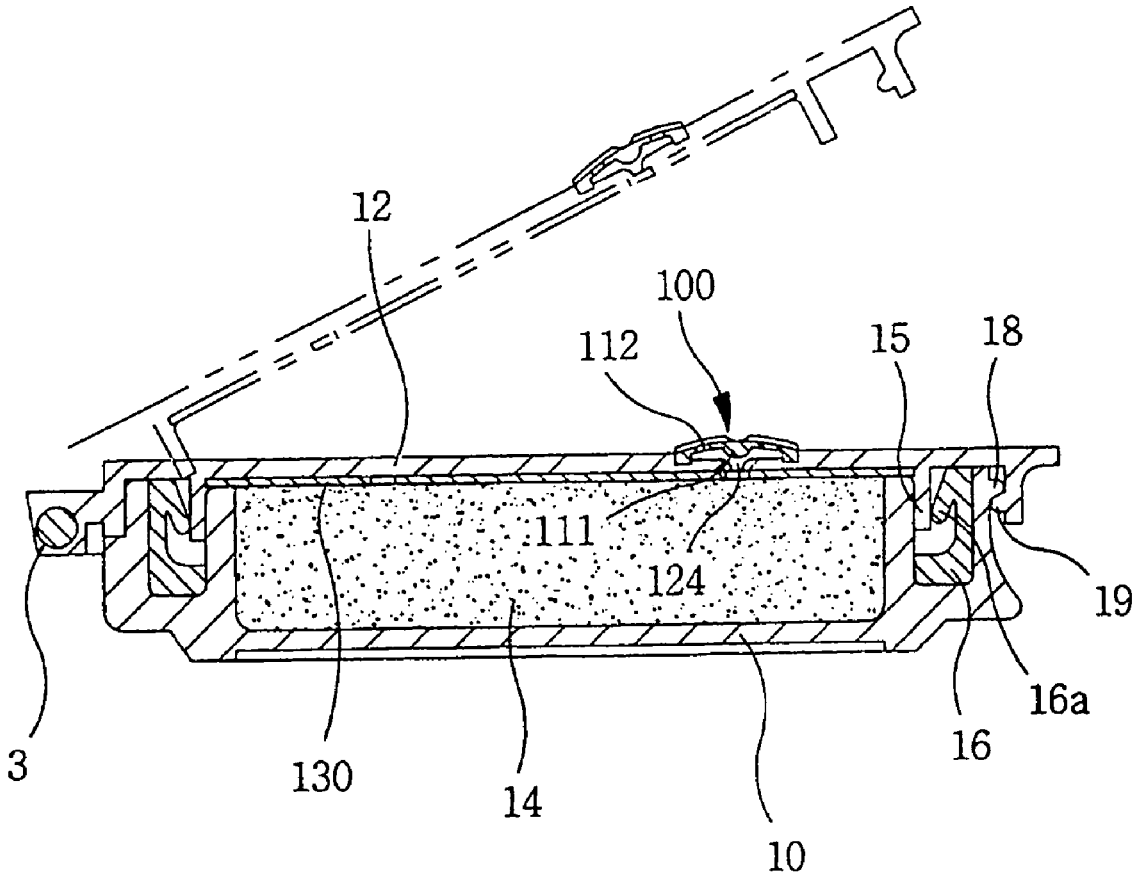

FIG. 9 is a sectional projection illustrating a valve according to still another embodiment of the present invention having the second cover in which a supporting plate is provided.

DETAILED DESCRIPTION OF THE INVENTION

In the description of the present invention, same reference numbers are attached to the same members shown in FIG. 1, and detailed description about those of members is omitted.

Referring to FIG. 4 through FIG. 6, the present invention comprise the second cover (12) having a safe landing pit (122) with a first ventilating opening and a valve (100) shaped by a tension plate (110) with a protrusion portion (111) in its bottom surface and the second ventilating openings (112) more than one are provided.

Further air duct is provided on the upper side of the tension plate (110) of the valve (100) so as to the air through the second ventilating opening (112) is discharged to outside while tension plate (110) is pressed when the first cover (2) is closed.

The air duct can be in the shape of "+" as shown in FIG. 4, in the shape of "–" or in other shape.

And it is preferred that the second ventilating opening (112) is provided on the air duct (114) and the tension plate (110) is covered upward for providing good tension function.

On the other hand, regarding the state that the valve (100) is landed on the second cover (12), protrusion (111) of tension plate (110) is placed toward the first ventilating opening (124) of the second cover (12) by predetermined distance when valve (100) is landed and fixed to the safe landing pit (122) which is provided in the second cover (12).

That is, protrusion (111) is separated from the first ventilating opening (124) of the second cover (12) when the second cover (12) only is closed because the tension plate (110) is covered upward.

Thus, ventilation in the refill container (10) is performed smoothly through the first ventilating opening (124) of the second cover (12) and the second ventilating opening (112) of tension plate (110).

Although rip (15) is adhered to wing piece (16*a*) of packing (16) when the second cover (12) of the refill container (10), compressed air in the refill container (10) is discharged through the first ventilating opening (124) to outside because protrusion part (111) of the valve (100) opens the first ventilating opening (112) of the second cover. Thus the second cover (12) is free from the expanding pressure caused by air compression even though the refill container (10) is sealed.

And when the first cover (2) is closed after the closing of the second cover (12), the tension plate (110) of valve (100) which is landed on the upper side of the second cover (12) is pressed by force and then protrusion part (111) shaped in the beneath of tension plate (110) blocks the first ventilating opening (124) of the second cover (12).

Thus volatilization of materials of the beauty product is prevented because ventilation of the refill container (10) is blocked by valve (100), and the second cover (12) or the first cover (2) is kept from easy opening because the expanding pressure is not caused.

FIG. 8 shows modified embodiment of the present invention. Referring to the FIG. 8. Sunken portion (111*a*) is shaped to increase tension force of the protrusion (111) which is protruded downward of the valve (100) so that protrusion (111) elastically presses the first ventilating opening (124) when valve (100) is pressed thereby the effect of sealing is magnified.

FIG. 9 shows another embodiment of the present invention in which metal supporting plate (130) is provided on the inside surface of the rip (15), which is shaped under the second cover (12), by insert-projecting method on the projection of the product.

To ensure the sealing when the second cover (12) is closed, it is need that the joint between rip (15) and packing (16) is strong. It is happened that sealing of the refill container (10) is not kept when the second cover (12) is distorted by twist and then cosmetics can not be used, for materials of the beauty product is volatilized. Thus it is necessary to maintain the second cover (12) to keep in shape from twist.

If supporting plate (130) is insert-projected when the second cover (12) is made by projection molding as shown in FIG. 9. Twist of the second cover (12) caused by projection, long-time usage, etc can be prevented so that the product can be used longer and safely.

That is, it is all the same except that the second cover (12) is prevented from distortion by heat difference between inside and outside of the case or long time usage by adopting insert-projection method on making a product.

According to the present invention, sealing by the second cover is maintained as well as easier operation of closing because ventilation is performed by valve shaped in the second cover.

Because ventilation is blocked when the first cover is closed, volatilization of materials of the beauty product is prevented.

Because the second cover is not opened easily, the safeties of the product are maintained at high level.

While this invention has been particularly shown and described with reference to preferred embodiments thereof, it will be understood by those skilled in the art that various changes in form and details may be made therein without departing from the spirit and scope of the present invention as defined by the appended claims.

What is claimed is:

1. In the cosmetic case having a main body (1), first and second covers (2, 12) which reveal or cover the main body (1) and a refill container (10) respectively, a hinge portion (3) which is attached to the outside of the main body (1) so as to let covers (2, 12) move respectively, and locking devices for each cover are provided, where the main body (1) has a cartridge (4), in which the refill container (10) is inserted, and a powder container (6) for powder (20), and a packing (16) is provided along a side-surface of the refill container (10) containing materials of the beauty product with a volatile agent, the cosmetic case is characterized in that:

a safe landing pit (122) with a first ventilating opening (124) and a valve (100) shaped by a tension plate (110) with a protrusion portion (111) in its bottom surface and a second ventilating opening (112) are provided in the second cover (12) for the refill container (10), wherein the compressed air inside of the refill container (10) is discharged to outside through the first ventilation opening (124) of the safe landing pit (122) and the second ventilation opening (112) of the valve (100) when the second cover (12) for the refill container (10) only is closed, and the first ventilation opening (124) of the second cover (12) is blocked to seal by the protrusion portion (111) of the valve (100) which is pressed downward by the first cover (2) for the main body (1) when the first cover (2) is closed after closing the second cover (12).

2. The cosmetic case of the claim 1, wherein an air duct (114) is provided on the upper side of the tension plate (110) of the valve (100) so as to prevent the first cover (2) from blocking the second ventilating opening (112) and blocking discharge of air when the first cover (2) is closed.

3. The cosmetic case of claim 1, wherein a sunk portion (111*a*) is provided on the protrusion part (111), which is provide in the bottom side of tension plate (110) in the valve (100), so as to increase an adhering area toward the first ventilating opening (124).

4. The cosmetic case of the claim 1, wherein the second cover (12) has a supporting plate (130) to prevent distortion by long-time usage or projection molding.

* * * * *